United States Patent [19]

Sakai

[11] Patent Number: 4,637,742

[45] Date of Patent: Jan. 20, 1987

[54] WIRE DRIVE CIRCUIT IN DOT-MATRIX PRINTER

[75] Inventor: Kiyoharu Sakai, Suzuka, Japan

[73] Assignee: Brother Kogyo Kabushiki Kaisha, Aichi, Japan

[21] Appl. No.: 742,907

[22] Filed: Jun. 10, 1985

[30] Foreign Application Priority Data

Jun. 15, 1984 [JP] Japan ..... 59-124194

[51] Int. Cl.[4] ..... B41J 9/38; B41J 3/12

[52] U.S. Cl. ..... 400/121; 101/93.05; 101/93.29; 400/157.2; 361/152

[58] Field of Search ..... 400/121, 124, 157.2, 400/157.3; 101/93.04, 96.05, 93.29, 93.48; 361/152, 153, 159

[56] References Cited

U.S. PATENT DOCUMENTS 4,254,705 3/1981 Ishikawa ..... 400/157.2 X
4,454,558 6/1984 Huddart ..... 361/153

FOREIGN PATENT DOCUMENTS 36468 3/1983 Japan ..... 101/93.48
123686 7/1984 Japan ..... 101/93.29

OTHER PUBLICATIONS

*IBM Tech. Disc. Bulletin,* by W. A. Boothroyd, vol. 12, No. 7, Dec., 1969, pp. 963–964.

*Primary Examiner*—Paul T. Sewell
*Attorney, Agent, or Firm*—Parkhurst & Oliff

[57] ABSTRACT

A wire drive circuit in an impact dot-matrix printer, having plural solenoids for actuating print wires, a first switching element connected commonly to one ends of the solenoids, plural second switching elements connected in series to the other ends of the solenoids, and a DC power supply connected to the first switching element and to the second switching elements, for selectively energizing the solenoids by turning on the first switching element and the respective one of the second switching elements. The wire drive circuit comprises: plural rectifying elements connected to the other ends of the solenoids; a discharge switching element which is connected to the other ends of the solenoids through the respective rectifying elements, and is turned on when the first switching element is turned off, to discharge electric energy produced by the previously energized solenoid; a main energy-absorbing element connected to the discharge switching element, for absorbing the discharged electric energy; and an auxiliary energy-absorbing capacitor connected to the other ends of the solenoids through the rectifying elements, to absorb a portion of the electric energy which has not been discharged through the discharge switching element, after the discharge switching element is turned off.

9 Claims, 8 Drawing Figures

WIRE DRIVE CIRCUIT IN DOT-MATRIX PRINTER

BACKGROUND OF THE INVENTION

1. Field of the Art

The present invention relates to a circuit for actuating print wires in an impact dot-matrix printer.

2. Related Art Statement

In the art of impact type dot-matrix printers using a row of stiff print wires, attempts have been made to increase the printing speed.

A known wire drive circuit is illustrated in FIG. 6, wherein solenoids L1–L4 for actuating individual print wires are connected at their one end to respective solenoid-selecting transistors Tr1–Tr4, and at their other end to a common power supply E through a power-on/off transistor Tr5. The solenoids L1–L4 are selectively energized by turning on the respective one of the solenoid-selecting transistors Tr1–Tr4 while the power-on/off transistor Tr5 is held on, whereby the corresponding print wires are selectively actuated to make dots on a recording medium. For example, signals SG1 and SG5 are applied to the solenoid-selecting transistor Tr1 and the power-on/off transistor Tr5, respectively, for a time span T1, as indicated in FIG. 7, to turn on these two transistors Tr1 and Tr5, whereby the solenoid L1 is energized with an electric current I1 flowing therethrough. Thus, the corresponding print wire is actuated. When the two transistors Tr1 and Tr5 are turned off after the time span T1, electric energy produced by the solenoid L1 is discharged through a discharge circuit which includes a diode D1, the power supply E, a diode D5 and the solenoid L1.

In the case where the signal SG1 is applied again to the transistor Tr1 after the discharge current Ia flowing through the above-indicated discharge circuit, namely through the solenoid L1, has been reduced to zero, there is no problem. In this connection, it is noted that the minimum operating interval of any print wire is limited primarily by mechanical factors, and therefore the minimum interval of energization of the corresponding solenoid is also limited. Due to this minimum time interval limitation, there is always a sufficient time between the successive energizations of the solenoid L1, for example, during which the aforementioned discharge current Ia may be reduced to zero. Further, for improving the printing quality, there is a comparatively less need to actuate the same print wire at reduced intervals. Therefore, the problem of the discharge current Ia does not exist when the same solenoid is energized repeatedly.

However, there arises a problem when different print wires are actuated one after another. Stated more specifically, to increase the operating frequency of the print wire, the period at which the signals SG1–SG4 are generated should be shortened. If, for instance, the signals SG5 and SG2 are generated to turn on the transistors Tr5 and Tr2 for energizing the solenoid L2 while the energy produced by the previously energized solenoid L1 is still being discharged as the current Ia (FIG. 7), the above-indicated discharge circuit including the solenoid L1 is shorted by a circuit which is constituted by the diode D1, power-on/off transistor Tr5 and solenoid L1. Consequently, the impedance of the discharge circuit is reduced, and the attenuation of the discharge current Ia may not be completed in a short time. If the solenoid L1 is energized again in this condition, the current I1 to energize the solenoid L1 is added to the remaining discharge current Ia. Repetition of the above cycle will cause a progressive increase in the current I1 which energizes the solenoid L1, and eventually result in the solenoid L1 being kept energized. For this reason, a comparatively long time is required between the generation of the signal SG1 and the generation of the signal SG2, if the signal SG2 following the signal SG1 is followed by the signal SG1 as in the above case. Thus, it is impossible to start energizing the solenoid L2 soon after the signal SG1 has been removed.

Hence, in the above-discussed arrangement of the known wire drive circuit, it is difficult to reduce the interval of generation of the signals for energizing the solenoid for a print wire and the solenoids for the other print wires, in a repeated fashion. Namely, it is difficult to increase the operating frequency of the print wires.

For solving the above problem, the drive circuit may be modified as indicated in FIG. 8. In this modified circuit, plural power-on/off transistors Tr5–Tr8 are provided correponding to the individual solenoids L1–L4, so that the solenoids L1–L4 are energized when the respective solenoid-selecting transistors and the corresponding power-on/off transistors are turned on. This arrangement permits the attenuation of the aforementioned discharge current in a shorter period. Therefore, the solenoids may be energized repeatedly at an increased frequency.

However, the modified drive circuit of FIG. 8 uses a comparatively larger number of components (including diodes D6–D8 and transistors Tr6–Tr8), which inherently pushes up the cost of the drive circuit.

SUMMARY OF THE INVENTION

It is therefore an object of the present invention to provide a wire drive circuit for a dot-matrix printer, which alleviates the above-indicated inconveniences experienced in the prior art, and makes it possible to actuate the print wires of the printer at an increased frequency.

According to the present invention, there is provided a wire drive circuit in a dot-matrix printer, having a plurality of solenoids for actuating individual print wires, a power-on/off switching element connected commonly to one ends of the solenoids, a plurality of solenoid-selecting switching elements connected in series to the other ends of the solenoids, respectively, and a DC power supply connected between the power-on/off switching element and the solenoid-selecting switching elements, so that the solenoids are selectively energized by turning on the power-on/off switching element and respective one of the solenoid-selecting switching elements, whereby the print wires are selectively actuated under selective energization of the respective solenoids, the wire drive circuit comprising: a plurality of rectifying elements connected to the aforementioned other ends of the solenoids, respectively; a discharge switching element connected to the other ends of the solenoids through the respective rectifying elements, and turned on when the power-on/off switching element is turned off, to discharge electric energy which is produced by the solenoids; main energy-absorbing means connected to the discharge switching element for absorbing the electric energy discharged through the discharge switching element; and an auxiliary energy-absorbing capacitor connected to the other ends of the solenoids through the respective rectifying elements, to absorb a portion of the electric energy which has not been discharged through the discharge switching element, after the discharge switching element has been turned off.

In the wire drive circuit of the invention constructed as described above, the discharge switching element is turned on when the power-on/off switching element is turned off, so that the electric energy produced by the solenoid upon deactivation of the power-on/off switching element may be absorbed by the main energy-absorbing means through the discharge switching element. Further, when the power-on/off switching element is turned on again, the discharge switching element is turned off, so that the electric energy which has not been discharged through the discharge switching element may be absorbed by the auxiliary energy-absorbing capacitor. Therefore, the instant wire drive circuit is substantially free from the conventionally experienced problem of progressive increase in the solenoid energizing current upon repeated energization of the solenoid. Accordingly, the wire drive circuit of the invention enables the print wires to be operated at an increased frequency, which provides an increase in the printing speed of the dot-matrix printer.

The main energy-absorbing means may be provided in the form of a capacitor connected to the discharge switching element. The capacitor may be incorporated in the DC power supply, that is, the DC power supply may serve as the main energy-absorbing means. In this case, the DC power supply is connected in series to the discharge switching element, a parallel circuit of the rectifying elements and a parallel circuit of the solenoids. The capacitor may be an electrolytic capacitor incorporated in the DC power supply.

According to an advantageous embodiment of the invention, the wire drive circuit comprises another rectifying element, and the auxiliary energy-absorbing capacitor is connected in series to the above another rectifying element, the power-on/off switching element, a parallel circuit of the selenoids, and a parallel circuit of the rectifying elements, whereby there is formed an energy-absorbing circuit in which the remaining discharge current is absorbed by the auxiliary energy-absorbing capacitor.

According to another advantageous embodiment of the invention, the wire drive circuit comprises another rectifying element, and the discharge switching element is connected in series to the auxiliary energy-absorbing capacitor, the above another rectifying element and the DC power supply, whereby there is formed a discharge circuit. In this arranement, the electric energy stored in the auxiliary energy-absorbing capacitor while the discharge switching element is off, is discharged into the DC power supply when the discharge switching element is turned on, so that the voltage across the auxiliary energy-absorbing capacitor becomes equal to that of the DC power supply.

In accordance with a further advantageous embodiment of the invention, the wire drive circuit comprises a resistor and another rectifying element, and the auxiliary energy-absorbing capacitor, the resistor, the DC power supply and the above another rectifying element are connected in series, whereby a charge circuit for charging the auxiliary energy-absorbing capacitor is formed. In this arrangement, the auxiliary energy-absorbing capacitor is charged until its voltage rises to that of the DC power supply. Consequently the impedance of the capacitor to the solenoids is increased, and the discharge current from the solenoids may be effectively attentuated.

BRIEF DESCRIPTION OF THE DRAWING

The above and other objects, features and advantages of the present invention will be better understood from reading the following detailed description of a preferred embodiment, in conjunction with the accompanying drawing in which:

FIG. 2 is a diagram showing discharge circuits which are formed while a discharge switching transistor is held on;

DETAILED DESCRIPTION OF THE PREFERRED EMBODIMENT

To further clarify the present invention, a preferred embodiment of the invention will be described in detail by reference to the accompanying drawing.

Figure 1:
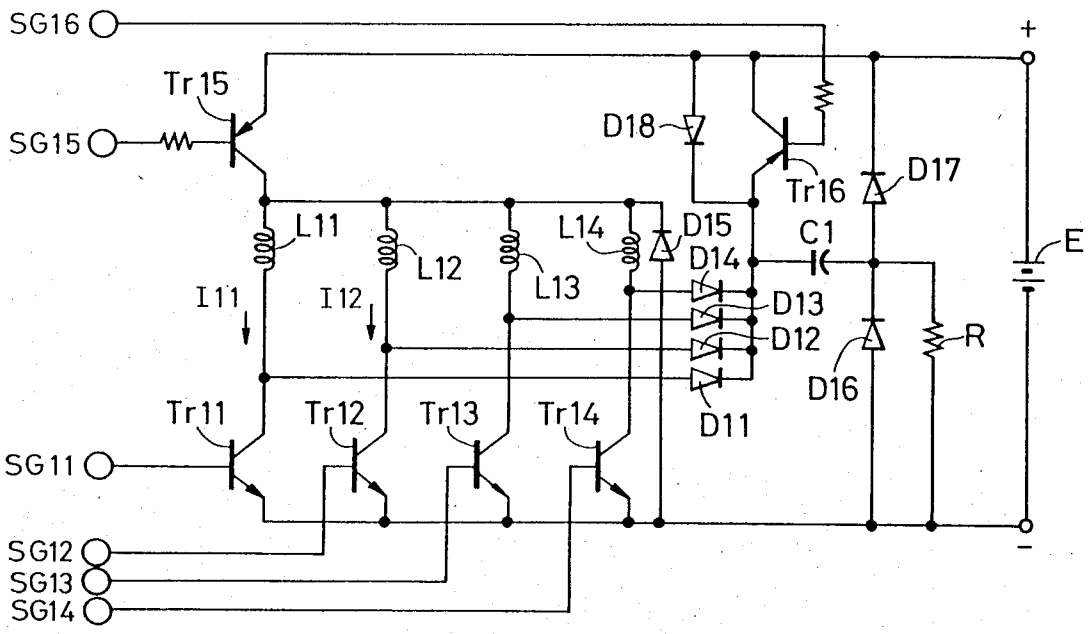
FIG. 1 is a diagram showing a wire drive circuit embodying the invention.

There is first shown in FIG. 1 one form of a wire drive circuit for an impact type dot-matrix printer, embodying the concept of the invention, wherein four solenoids L11–L14 are provided for actuating corresponding individual print wires of the printer. The solenoids L11–L14 are connected at their one end to a common DC power supply E through a common power-on/off switching element in the form of a power-on/off transistor Tr15, and are connected at their other end to respective solenoid-selecting switching elements in the form of solenoid-selecting transistors Tr11–TR14. The power-on/off transistor Tr15 is connected at its emitter to a positive terminal of the DC power supply E, and at its collector to the solenoids L11–L14. The solenoid-selecting transistors Tr11–Tr14 are connected at their collector to the respective solenoids L11–L14, and at their emitter to a negative terminal of the DC power supply E. The power-on/off and solenoid-selecting transistors Tr15 and Tr11–Tr14 are turned on when corresponding signals SG15 and SG11–SG14 are applied to their base. The solenoids L11–L14 are energized when the respective solenoid-selecting transistors Tr11–TR14 are turned on while the power-on/off transistor Tr15 is held on. Thus, the individual print wires of the dot-matrix printer are actuated under selective energization of the corresponding solenoids L11–L14.

A discharge diode D15 is connected between the collector of the power-on/off transistor Tr15 and the negative terminal of the DC power supply.

Figure 4:
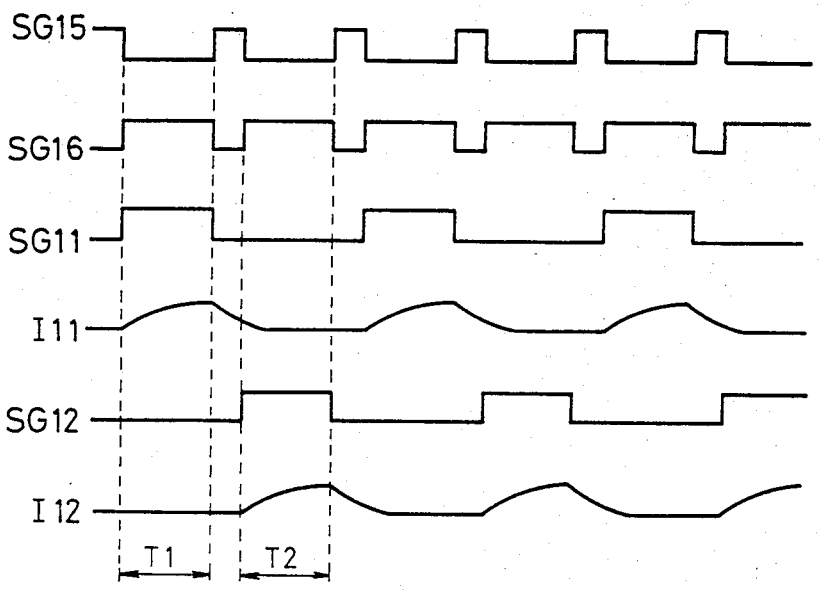
FIG. 4 is a timing chart explaining the operation of the drive circuit.

Four rectifying elements in the form of diodes D11–D14 are connected to the ends of the solenoids L11–L14 at which they are connected to the solenoid-selecting transistors Tr11–Tr14. The same ends of the solenoids L11–L14 are connected, through the respective rectifying diodes D11–D14, to the emitter of a discharge transistor Tr16 which serves as a discharge switching element. The collector of the discharge transistor Tr16 is connected to the positive terminal of the DC power supply. The discharge transistor Tr16 is turned on when a signal SG16 is applied to its base. A control unit (not shown) which generates the signals SG15 and SG16 and other signals is adapted such that the discharge transistor Tr16 is turned on when the power-on/off transistor Tr15 is turned off, and vice versa, as indicated in FIG. 4.

Figure 5:
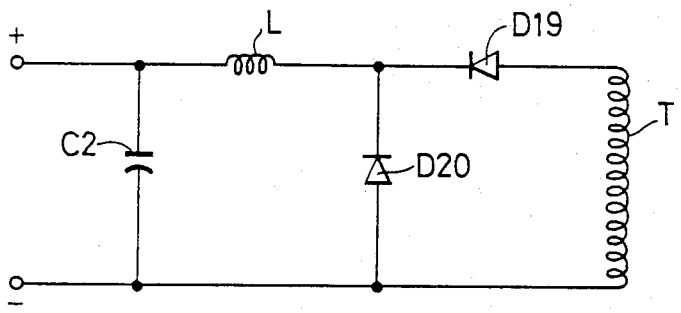
FIG. 5 is a diagram illustrating a DC power supply circuit of the wire drive circuit of FIG. 1.
Figure 6:
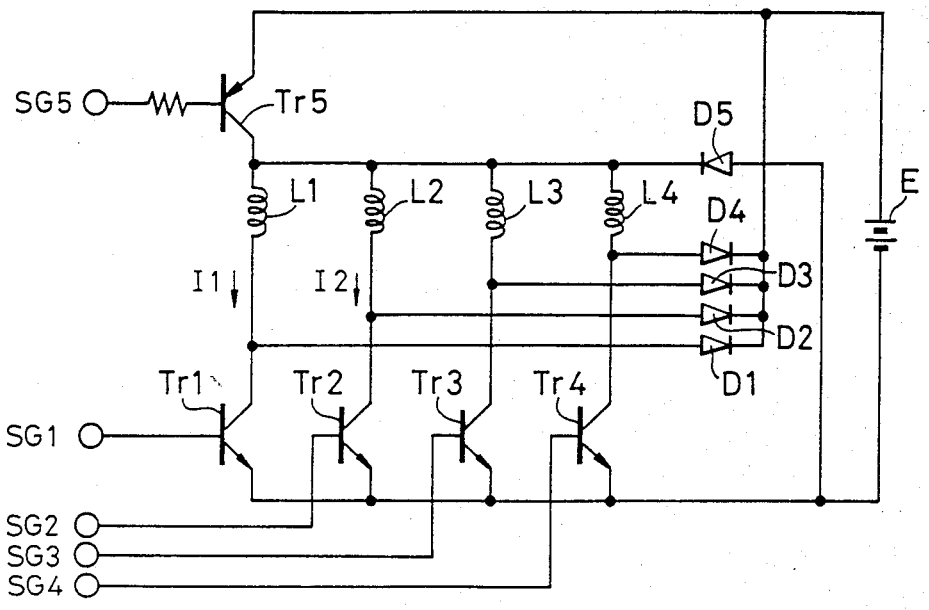
FIG. 6 PRIOR ART
FIG. 6 is a diagram showing a known wire drive circuit.
Figure 7:
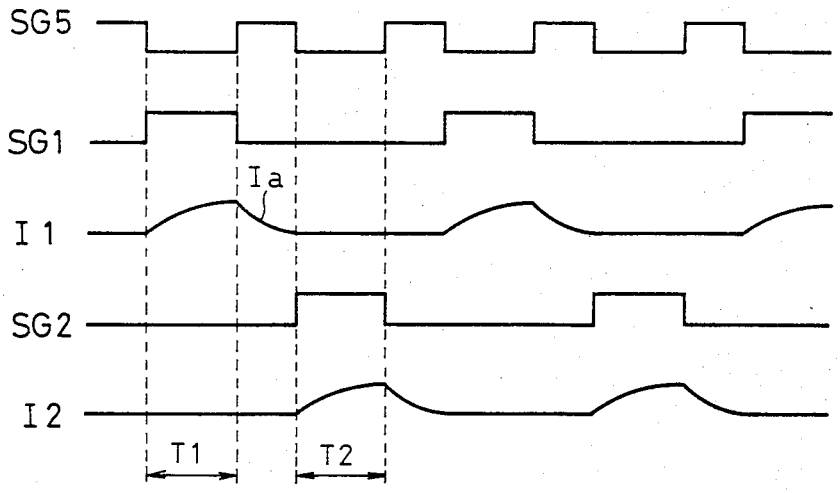
FIG. 7 PRIOR ART
FIG. 7 is a timing chart of the known wire drive circuit of FIG. 6.
Figure 8:
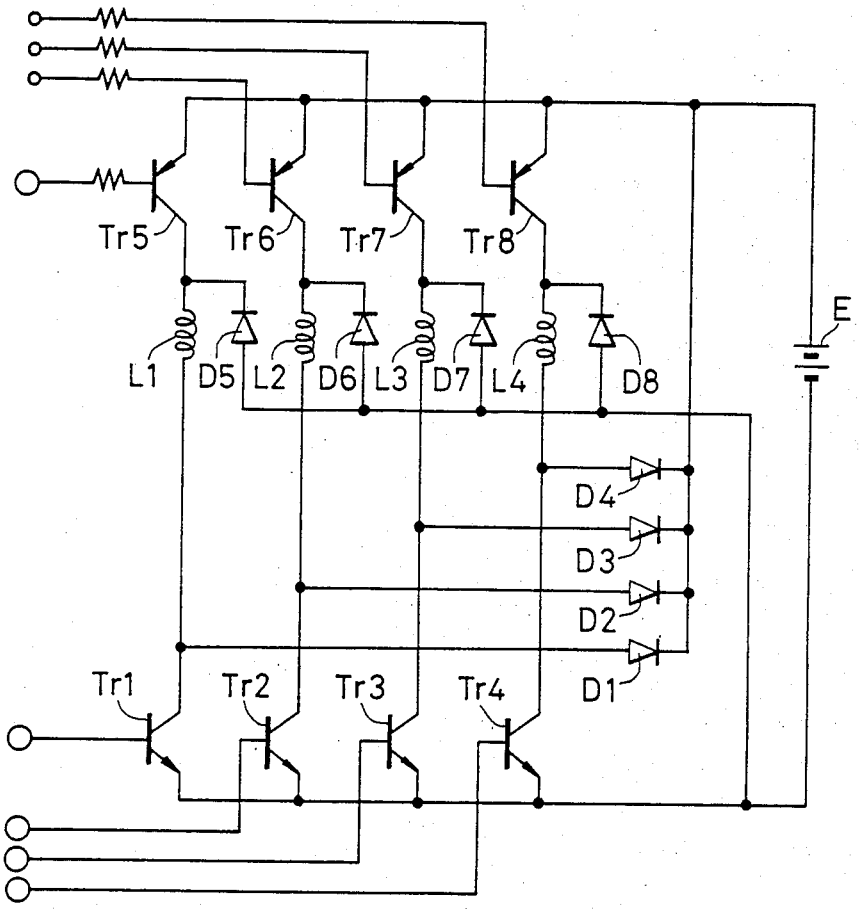
FIG. 8 PRIOR ART
FIG. 8 is a diagram showing another known wire drive circuit.

As shown in FIG. 5, the DC power supply E is provided in the form of a half-wave rectification circuit which includes a transformer T, a diode D19, a choke coil L, an electrolytic capacitor C2 (three 1000-microfarad capacitors connected in parallel), and a diode D20. The transformer T is connected at one end to the emitter of the power-on/off transistor Tr15 through the diode D19 and the choke coil L. The other end of the transformer T is connected to the emitters of the solenoid-selecting transistors Tr11–Tr14. The electrolytic capacitor C2 is provided to absorb a counter electromotive force which is produced by the choke coil L when the power-on/off transistor Tr15 is turned off. In addition, the electrolytic capacitor C2 serves as main energy-absorbing means for the wire drive circuit, the function of which will be described later.

An auxiliary energy-absorbing capacitor C1 is connected at its one end to the emitter of the discharge transistor Tr16, and to the solenoids L11-L14 through the rectifying diodes D11–D14. The other end of the auxiliary energy-absorbing capacitor C1 is connected to the negative terminal of the DC power supply through a parallel circuit including a resistor R and a rectifying diode D16.

A rectifying diode D17 is connected at one end to the above parallel circuit of the resistor R and diode D16, and at the other end to the positive terminal of the DC power supply E. A rectifying diode D18 is connected to the collector and emitter of the discharge transistor Tr16.

The operation of the wire drive circuit constructed as described hitherto will be discussed.

While the solenoid-selecting transistors Tr11–Tr14 are all held off, the auxiliary energy-absorging capacitor C1 is charged via the rectifying diode D18, so that the voltage across the capacitor C1 is equal to that of the DC power supply E.

Figure 2:
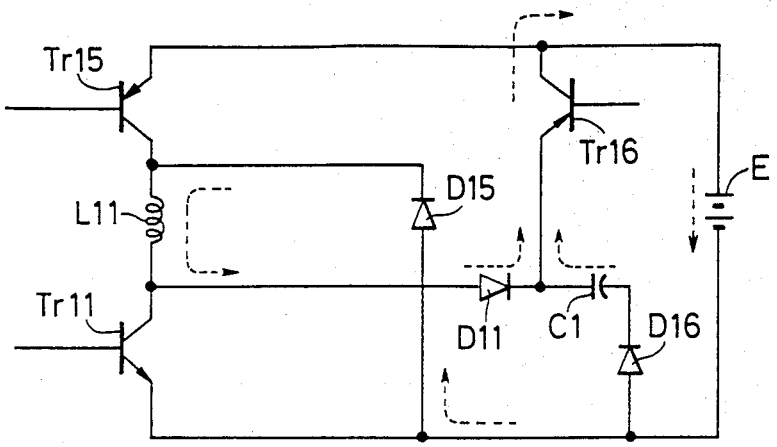

If, for example, the siganls SG15 and SG11 are applied to the power-on/off transistor Tr15 and to the solenoid-selecting transistor Tr11, respectively, the transistors Tr15 and Tr11 are both turned on, and an electric current I11 flows through the solenoid L11 as indicated in FIGS. 1 and 4, whereby the solenoid L11 is energized. When the transistors Tr15 and Tr11 have been turned off after a time span T1 (FIG. 4), a counter electromotive force is produced in the solenoid L11, and a potential at the end of the solenoid L11 on the side of the collector of the transistor Tr11 becomes higher than that of the line voltage. However, since the discharge transistor Tr16 is turned on as soon as the transistors Tr15 and Tr11 have been turned off, the electric energy (I11) produced in the solenoid L11 is dishcarged through a discharge circuit which is constituted by the rectifying diode D11, discharge transistor Tr16, DC power supply E, discharge diode D15 and solenoid L11, as indicated in arrow-headed broken line in FIG. 2. More specifically, the remaining current I11 is absorbed by the electrolytic capacitor C2 in the DC power supply E. An electric current flowing through the rectifying diode D16 and the auxiliary energy-absorbing capacitor C1, will be described later.

Figure 3:
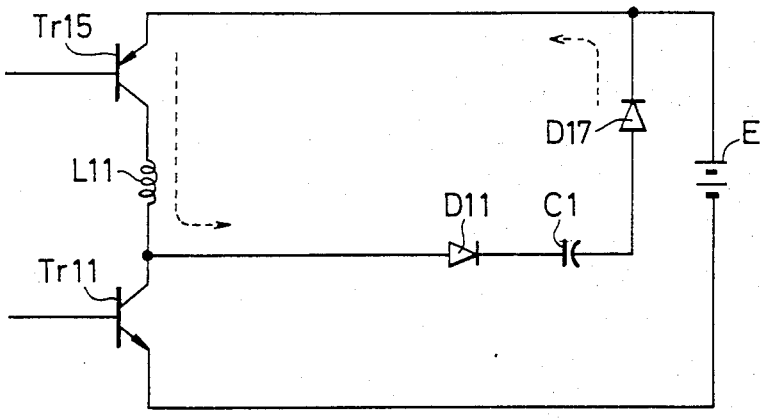
FIG. 3 is a diagram showing an energy-absorbing circuit which is formed while the discharge switching transistor is held off.

When the signals SG15 and SG12 are applied to the power-on/off transistor Tr15 and the solenoid-selecting transistor Tr12 before the current I11 has not been completely discharged through the discharge transistor Tr16, the transistors Tr15 and Tr12 are turned on with a result of a current I12 starting to flow through the solenoid L12. At this time, the discharge transistor Tr16 is turned off, and consequently the still remaining current I11 is discharged through an energy-absorbing circuit which is constituted by the rectifying diode D11, auxiliary enregy-absorbing capacitor C1, rectifying diode D17, power-on/off transistor Tr15 and solenoid L11, as shown in arrow-headed broken line in FIG. 3. That is, the remaining current I11 is absorbed by the auxiliary energy-absorbing capacitor C1, with a result of effective attentuation of the remaining electric energy due to high impedance of the capacitor C1.

Therefore, the discharge of the electric energy I11 of the solenoid L11 is effected independently of the current flow associated with the energization of the solenoid L12, and the attenuation of the remaining current I11 associated with the previously energized solenoid L11 may be completed within a relatively short period of time. That is, the discharge of the remaining current I11 is completed by the time the solenoid L11 is energized again after a time span T2 of energization of the solenoid L12. For this reason, it is possible to shorten the time interval between the end of the preceding energization of the solenoid L11 and the start of its next energization, i.e., to increase the operating frequency of the solenoid L11 even if the solenoid L12 is energized following the solenoid L11.

Stated the other way, the instant arrangement of the wire drive circuit requires a comparatively short period of time after the end of energization of the solenoid L11, and before the complete discharge of the remaining current, viz., before the solenoid L11 becomes ready to be energized again. Therefore, the solenoid L11 may be energized at relatively short time intervals, without a conventionally encountered progressive increase in the energization current, which may cause the solenoid L11 to be held energized (that is, cause the corresponding print wire to fail to be moved between its advanced and retracted positions).

After the elapse of the energization time span T2 of the solenoid L12, the discharge transistor Tr16 is again turned on. As a result, the discharge transistor Tr16, DC power supply E, rectifying diode D16, and auxiliary energy-absorbing capacitor C1 constitute a discharge circuit in which the electric energy stored in the capacitor C1 is discharged into the electrolytic capacitor C2 in the DC power supply E, until the voltage across the capacitor C1 becomes equal to the voltage of the DC power supply E. In this condition, the capacitor C1 still maintains a high level of impedance, which assures effective attenuation of an electric energy that is produced by the solenoid L12 at the end of its energization (T2).

While the operation of the wire drive circuit to energize the solenoids L11 and L12 has been described above, similar events will take place in the wire drive circuit when the other solenoids are energized.

Although the present invention has been described in its preferred embodiment with a certain degree of particularity, it is to be understood that the invention is not confined to the precise disclosure contained herein, but may be otherwise embodied with various changes, modifications and improvements which may occur to those skilled in the art, in the light of the foregoing teachings, without departing from the scope of the invention defined in the appended claims.

What is claimed is:

1. A wire drive circuit in a dot-matrix printer, having a plurality of solenoids for actuating individual print wires, a power-on/off switching element connected commonly to a first end of each of the solenoids, a plurality of solenoid-selecting switching elements, each of the solenoid-selecting switching elements being connected in series to a second end of a respective solenoid, and a DC power supply connected between the power-on/off switching element and the solenoid-selecting switching elements, the solenoids being selectively energized by turning on said power-on/off switching element and respective one of the solenoid-selecting switching elements, whereby the print wires are selectively actuated under selective energization of the respective solenoids, said wire drive circuit further comprising:

a plurality of recifying elements connected to said second ends of the solenoids;

a discharge switching element connected to said second ends of said solenoids through the respective rectifying elements, said discharge switching element being turned on and off when said power-on/off switching element is turned off and on, respectively, to discharge electric energy which is produced by the solenoid previously energized when said power-on/off switching element in turned on;

main energy-absorbing means, connected to said discharge switching element, for absorbing said electric energy while said discharge switching element is on; and an auxiliary energy-absorbing capacitor connected to said second ends of said solenoids through said rectifying elements, to absorb a portion of said electric energy which has not been discharged through said discharge switching element, after the discharge switching element is turned off.

2. A wire drive circuit as set forth in claim 1, wherein said main energy-absorbing means comprises a capacitor connected to said discharge switching element.

3. A wire drive circuit as set forth in claim 1, wherein said DC power supply is connected in series to said discharge switching element, a parallel circuit of said rectifying elements and a parallel circuit of said solenoids so that the DC power supply serves as said main energy-absorbing means.

4. A wire drive circuit as set forth in claim 3, wherein said DC power supply comprises an electrolytic capacitor which absorbs a discharge current from said solenoids.

5. A wire drive circuit as set forth in claim 1, further comprising another rectifying element, and wherein said auxiliary energy-absorbing capacitor is connected in series to said another rectifying element, said power-on/off switching element, a parallel circuit of said solenoids, and a parallel circuit of said rectifying elements, whereby an energy-absorbing circuit is formed.

6. A wire drive circuit as set forth in claim 1, further comprising another rectifying element, and wherein said discharge switching element is connected in series to said auxiliary energy-absorbing capacitor, said another rectifying element and said DC power supply, whereby a discharge circuit is formed.

7. A wire drive circuit as set forth in claim 1, further comprising a resistor and another rectifying element, and wherein said auxiliary energy-absorbing capacitor, said resistor, said DC power supply and said another rectifying element are connected in series, whereby a charge circuit for charging said auxiliary energy-absorbing capacitor is formed.

8. A wire drive circuit as set forth in claim 1, wherein said rectifying elements are diodes.

9. A wire drive circuit as set forth in claim 1, wherein said power-on/off switching element, said solenoid-selecting switching elements, and said discharge switching element are transistors.

* * * * *